US009266699B2

(12) United States Patent
Ogava et al.

(10) Patent No.: US 9,266,699 B2
(45) Date of Patent: Feb. 23, 2016

(54) ELEVATOR SYSTEM AND OPERATION THEREOF

(75) Inventors: Mario Ogava, Sao Paulo (BR); Renato Kanno, Barao Sao Geraldo-Campinas (BR)

(73) Assignee: Inventio AG, Hergiswil (CH)

( * ) Notice: Subject to any disclaimer, the term of this patent is extended or adjusted under 35 U.S.C. 154(b) by 877 days.

(21) Appl. No.: 13/509,478

(22) PCT Filed: Oct. 25, 2010

(86) PCT No.: PCT/EP2010/066078

§ 371 (c)(1),
(2), (4) Date: Jul. 25, 2012

(87) PCT Pub. No.: WO2011/057890

PCT Pub. Date: May 19, 2011

(65) Prior Publication Data

US 2012/0279809 A1 Nov. 8, 2012

(30) Foreign Application Priority Data

Nov. 12, 2009 (EP) ..... 09175774

(51) Int. Cl.
*B66B 1/34* (2006.01)

(52) U.S. Cl.
CPC ..... *B66B 1/3492* (2013.01)

(58) Field of Classification Search
CPC ..... B66B 1/3492; B66B 3/02; B66B 3/023
USPC ..... 187/391, 393, 394
See application file for complete search history.

(56) References Cited

U.S. PATENT DOCUMENTS

| | | | | |
|---|---|---|---|---|
| 3,158,228 | A | 11/1964 | Bentley | |
| 5,070,967 | A * | 12/1991 | Katzy et al. | 187/297 |
| 5,844,180 | A * | 12/1998 | Liebetrau et al. | 187/394 |
| 5,921,351 | A * | 7/1999 | Schroder-Brumloop | 187/255 |
| 6,651,781 | B2 * | 11/2003 | Lindegger et al. | 187/394 |
| 6,776,263 | B2 * | 8/2004 | Gottlieb et al. | 187/251 |
| 7,540,357 | B2 * | 6/2009 | Finn et al. | 187/394 |

(Continued)

FOREIGN PATENT DOCUMENTS

| | | |
|---|---|---|
| CN | 1950287 A | 4/2007 |
| EP | 1493708 A2 | 1/2005 |

(Continued)

*Primary Examiner* — Anthony Salata
(74) *Attorney, Agent, or Firm* — Fraser Clemens Martin & Miller LLC; William J. Clemens

(57) ABSTRACT

An elevator system has an elevator car suspended on at least one synchronous belt driven by a drive driving a drive pulley in a non-slip manner, a distance measurement device measuring a travel distance of the belt at the drive pulley for determining a car position, a controller actuating the drive based on-stored stop location position values and a determined car position to stop the car at two or more stop locations, at least one position sensor disposed from the drive pulley and signaling the controller when the car passes a reference position, and a compensation device making a correction of the stored stop location position values with a correction factor based on the difference between the car position determined by the distance measurement device and the reference position as the car passes the reference position. Methods for operating the elevator system and initializing the controller are provided.

10 Claims, 3 Drawing Sheets

(56) References Cited

U.S. PATENT DOCUMENTS

| | | | | |
|---|---|---|---|---|
| 7,857,106 | B2 * | 12/2010 | Zapf | 187/394 |
| 7,938,233 | B2 * | 5/2011 | Kunz | 187/394 |
| 2005/0039987 | A1 * | 2/2005 | Redden | 187/394 |
| 2005/0269163 | A1 * | 12/2005 | Angst | 187/287 |
| 2008/0087502 | A1 | 4/2008 | Zapf | |
| 2010/0133046 | A1 * | 6/2010 | Allwardt et al. | 187/251 |
| 2014/0332326 | A1 * | 11/2014 | Mikkonen et al. | 187/414 |

FOREIGN PATENT DOCUMENTS

| | | | |
|---|---|---|---|
| WO | 2004106209 | A1 | 12/2004 |
| WO | 2006099770 | A1 | 9/2006 |

* cited by examiner 3 elevator car
4 counterweight
14 drive unit
15 pulse transmitter
17 controller
20 position sensor
22 reference element
26 compensating device
27 memory device
28 stop sensor
40 temperature measuring device

ELEVATOR SYSTEM AND OPERATION THEREOF

FIELD

The invention relates to an elevator system with at least one elevator car which is drivable by a drive unit by means of at least one supporting means.

BACKGROUND

EP 1 493 708 A2 discloses an elevator system with an elevator car and a counterweight, which are suspended on a supporting means connected to the elevator car and to the counterweight. In this case, the supporting means is designed as a toothed belt, and therefore the movement of the elevator car is determined as a function of the revolutions of the drive for the elevator car. As a result, the position of the elevator car in the shaft can be determined on the basis of the revolutions of the drive, and therefore no position determining means are required in the shaft.

The elevator system known from EP 1 493 708 A2 has the disadvantage that precise stopping on a floor cannot be ensured over the service life of the elevator system, since certain changes in length are unavoidable in the toothed belt used as the supporting means.

SUMMARY

It is an object of the invention to provide an elevator system, in which the position of the elevator car is determined in a simple manner. In particular, it is an object of the invention to provide an elevator system, in which, despite the simplicity of determining the position, the accuracy of the elevator car stopping at a stop is only slightly influenced by changes in length of the supporting means.

It should be noted that, in addition to the function of transmitting the force of a drive unit to the elevator car in order to move the elevator car, a supporting means may also have the function of supporting the elevator car.

The term "movement of the elevator car" should be understood as meaning in particular lifting or lowering of the elevator car, wherein the elevator car can be guided by one or more guide rails.

In one of the embodiments of the elevator system, the elevator system comprises a load measuring device for detecting the loading of the elevator car, and the compensating device brings about the correction of the stored stop position values with incorporation of an additional correction factor which compensates for a change in length of the synchronous belt as a result of load changes in the elevator car. In the event of load changes taking place between two correction operations triggered by the position sensor, the compensating device can mathematically determine a corresponding change in length of the synchronous belt and bring about an appropriate correction of the stop position values.

Such corrections as a result of load changes are superimposed on the corrections resulting from the evaluation of the reference position. As a result, imprecise stopping of the elevator car at stops as a result of changes in length of the synchronous belt caused by differing loading of the elevator car can be largely avoided.

In a further possible embodiment of the elevator system, the elevator system comprises a temperature measuring device, and the compensating device additionally brings about measurement of the movement travel with incorporation of a further correction factor which compensates for a change in length of the synchronous belt as a result of temperature changes. Such corrections as a result of temperature changes are superimposed on the corrections resulting from the evaluation of the reference position. By this means, during periods of time in which the elevator car never passes the position sensor, changes in length of the synchronous belt as a result of temperature fluctuations can be compensated for.

In a further possible embodiment of the elevator system, the reference position (24) is arranged in such a manner that the synchronous belt length present between the driving pulley (12) and the elevator car (3), upon the elevator car (3) passing the reference position (24), corresponds to at least 50% of the maximum length occurring during operation. A change in length of the synchronous belt is therefore detected over a large belt length, which is crucial for sufficient accuracy in the determination of the correction factor for correcting all of the stop position values.

In a further possible embodiment of the elevator system, the reference position is arranged in the region of a main stop of the elevator system. Such an arrangement ensures that the elevator car travels over the position sensor or the reference position sufficiently frequently for the correction of the stop position values which are stored in the controller to be carried out sufficiently frequently. A main stop is understood as meaning every stop which is arrived at by the elevator car more frequently than on average. Examples of main stops of this type are stops on the ground floor or stops which are provided for changing between different elevators (sky lobbies).

In a further possible embodiment of the elevator system, more than one reference position, each having an assigned position sensor, is arranged in the elevator system. An embodiment of this type is advantageous if there is no location in the region of movement of the elevator car that is sufficiently far away from the drive unit and is arrived at with sufficiently frequency by the elevator car.

In a further possible embodiment of the elevator system, the elevator system (1) comprises at least one further supporting means (6) in addition to a synchronous belt serving at least for driving and positioning the elevator car, wherein said supporting means (6) interacts with a non-driven, idling supporting means pulley (13) and serves only for supporting the elevator car.

In such an embodiment, the at least one synchronous belt can be at least partially relieved of load from the supporting function, which substantially increases the service life of the synchronous belt, which is customarily designed as a toothed belt. The above-described functions for correcting the stop position values are also applicable in this embodiment.

DESCRIPTION OF THE DRAWINGS

Exemplary embodiments of the invention are explained in more detail in the description below with reference to the attached drawings, in which.

DETAILED DESCRIPTION OF THE INVENTION

Figures 1, 2:
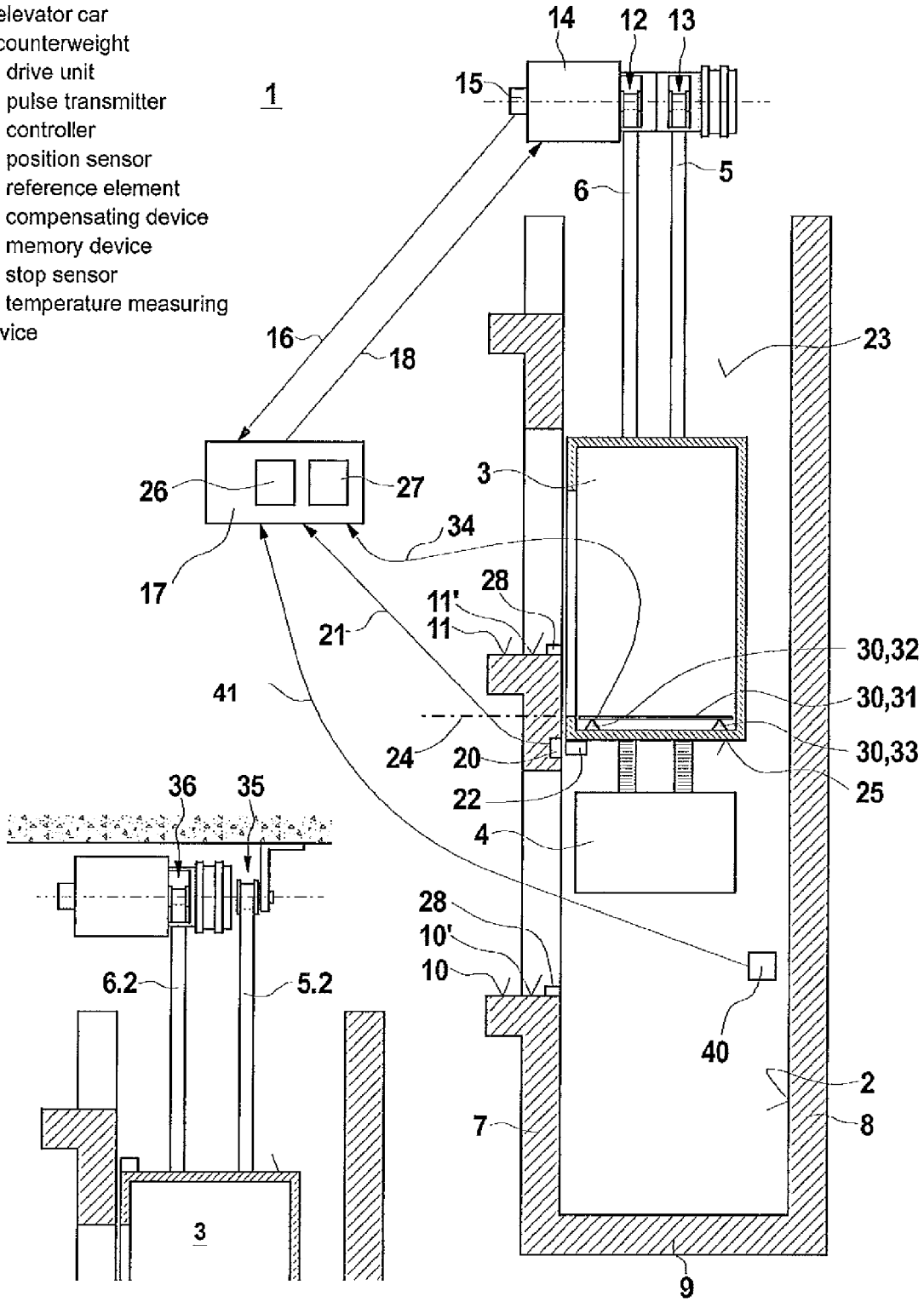
FIG. 1 shows an elevator system with an elevator car in a schematic illustration according to an exemplary embodiment of the invention.
FIG. 2 shows an alternate embodiment of the elevator system shown in FIG. 1.
Figure 3:
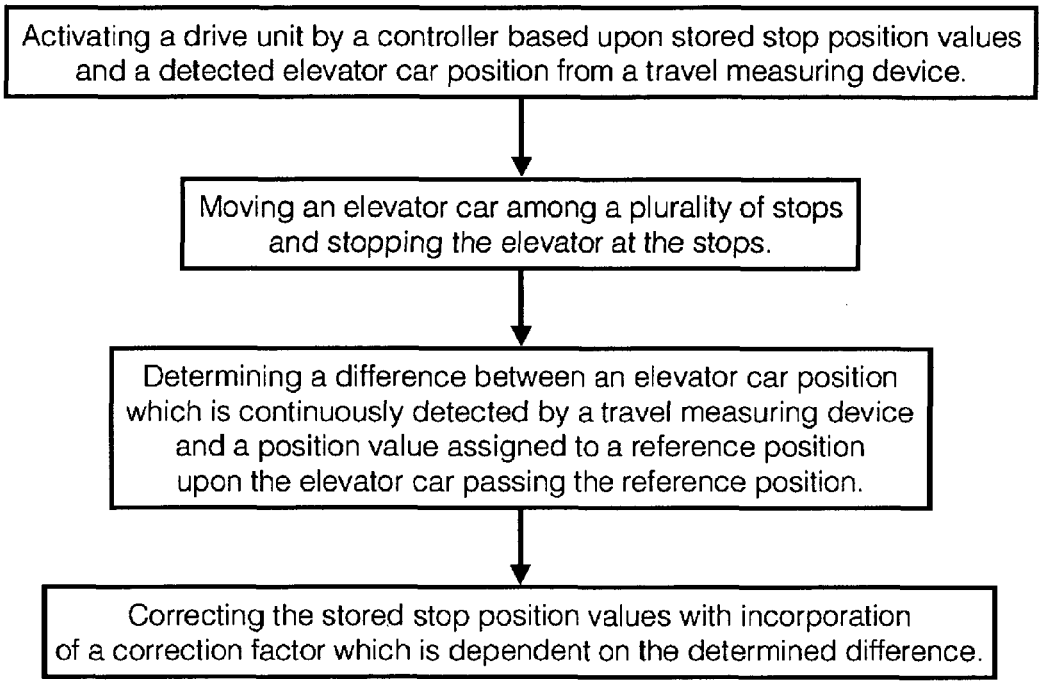
FIG. 3 shows a flow diagram of a method for operation an elevator system as described herein.
Figure 4:
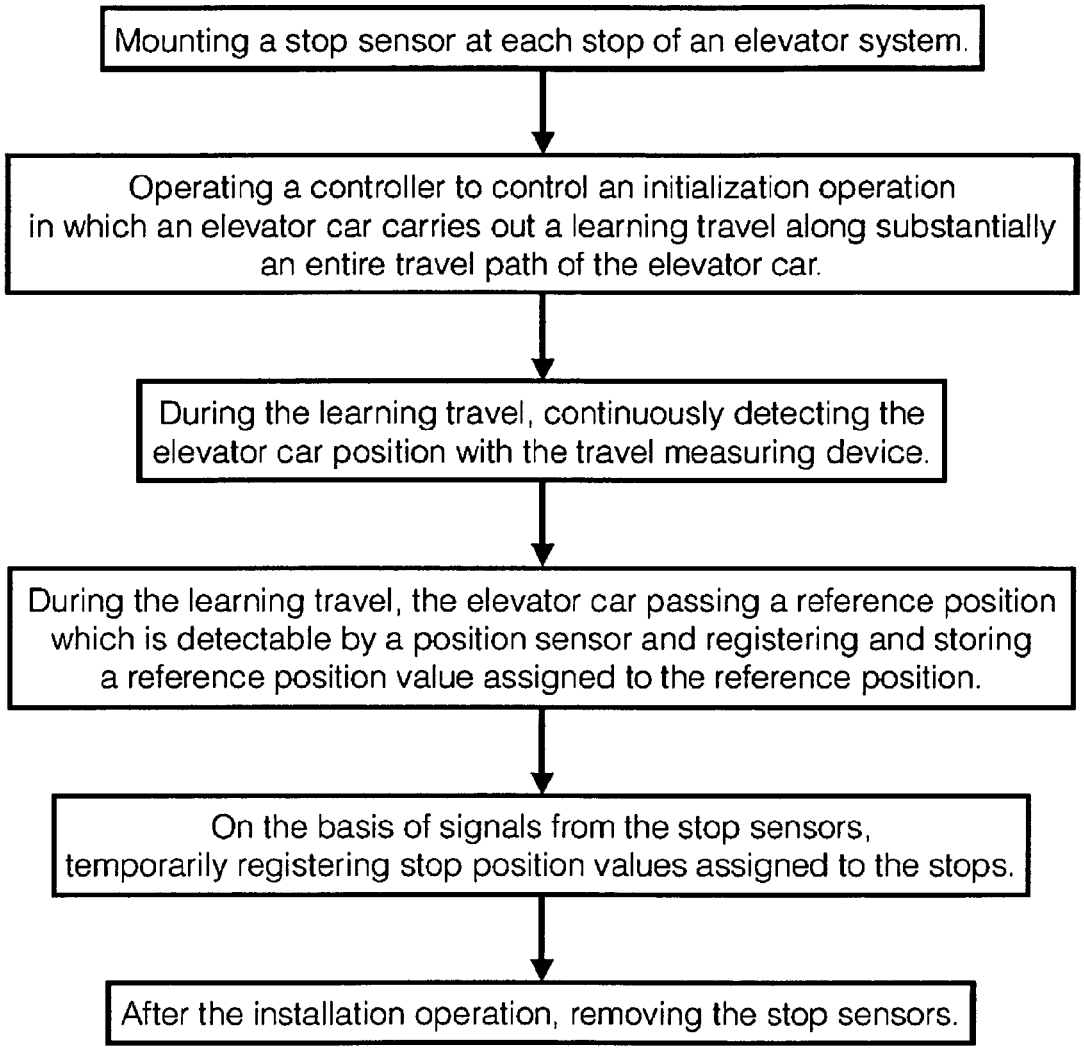
FIG. 4 shows a flow diagram of a method for initializing a controller of an elevator system as described herein.

FIG. 1 shows an elevator system 1 with an elevator shaft 2, an elevator car 3, a counterweight 4 and supporting means 5, 6. The elevator shaft 2 is delimited by lateral walls 7, 8 and a base 9. The elevator system 1 is illustrated schematically, wherein a plurality of floors 10, 11 are provided via which people, objects or other loads can enter or exit again from the elevator car 3 during operation. In this exemplary embodiment, the floors 10, 11 are illustrated by way of example, it also being possible to provide a significantly greater number of floors 10, 11.

The floor 10 determines a stop 10'. The floor 11 determines a stop 11'.

The elevator car 3 and the counterweight 4 are connected to the supporting means 5, 6. The supporting means 5, 6 are guided via driving pulleys 12, 13 of a drive unit 14. As a result, the elevator car 3 and the counterweight 4 are suspended on the supporting means 5, 6.

A travel measuring device in the form of a pulse transmitter 15 detecting the revolutions of the driving pulleys 12, 13 of the drive unit 14 is arranged on the drive unit 14. The resolution of the pulse transmitter 15 is matched here to the configuration of the drive unit 14, in particular of the driving pulleys 12, 13. The two supporting means 5, 6 are configured as synchronous belts which interact in a slip-free manner with the driving pulleys. The synchronous belts are in the form of toothed belts, and the driving pulleys are designed as toothed belt pulleys. A movement of the elevator car 3 via the supporting means 5, 6 is therefore detectable via the pulse transmitter 15, wherein the pulse transmitter 15 can be configured in such a manner that a movement of the elevator car 3 is detectable in the millimeter range. In this case, the revolutions of the drive unit 14 correlate to the distance covered by the elevator car 3, since the supporting means 5, 6 are driven without slipping by the driving pulleys 12, 13.

The travel measuring device present in the form of a pulse transmitter 15 in the present exemplary embodiment is connected via a signal line 16 to a controller 17 of the elevator system 1. The controller 17 is in turn connected via a signal line 18 to the drive unit 14 in order to activate the drive unit 14. As a result, the controller 17 can control the movement of the elevator car 3 by means of the drive unit 14.

Of course, the travel measuring device may also be present in a different form. For example, the travel of the synchronous belt in the region of the driving pulley can be detected directly at the synchronous belt by means of a synchronous measuring wheel. Other forms of measuring devices for detecting the revolutions of the drive unit 14 and/or of the driving pulley 12, 13 may also be used, for example mechanical counters.

A position sensor 20 which is connected to the controller 17 via a signal line 21 is mounted on the wall 7. The position sensor 20 has the object of signaling to the controller when the elevator car 3 passes a reference position 24. In this exemplary embodiment, the position sensor 20 is arranged in the region of the floor 10 and therefore in the region of the stop 10'. If, for example, the elevator car 3 travels from above to the stop 10', then, in the reference position 24 of the elevator car 3, which position is illustrated by FIG. 1, the position sensor 20 detects a reference element 22 mounted on the elevator car 3. In this exemplary embodiment, the reference element 22 is arranged in the region of a lower side 25 of the elevator car 3. A reference element 22 may be present in the form of an active element, for example in the form of an infrared light beam transmitter. However, it may also be present as a passive element, for example as a reflector which interacts with a position sensor 20 in the form of a reflection light scanner, or as a permanent magnet which actuates a position sensor 20 in the form of a magnetic switch.

The position sensor 20 or the reference position 24 may be arranged anywhere along the elevator shaft 2. However, in order to be able to ensure sufficient stopping accuracy, the reference position of the elevator car 3, which reference position is detected by the position sensor 20, is arranged in such a manner that, when the elevator car passes the reference position thereof, the synchronous belt length present between the driving pulley 12 and the elevator car 3 corresponds to at least 30%, or better at least 50% of the length which can occur at maximum between the driving pulley and elevator car during operation.

The controller 17 has a memory device 27 and a compensating device 26.

The elevator controller is initialized before the regular commissioning of the elevator system 1 or, for example, after a control period. In this case, the elevator car 3 is moved by manually activated control commands to the reference position 24. A position value which is assigned to the reference position 24 and expediently corresponds to the distance between the driving pulley 12 and the reference position is entered into and stored in the memory device 27. The elevator car 3 is subsequently moved, again by manually activated control commands, from the reference position to all of the stops 10', 11'. The positions of the individual stops 10', 11', i.e. the stop position values thereof, are in each case detected with the aid of the travel measuring device, which is present in the form of the pulse transmitter 15, and are likewise temporarily stored in the memory device 27. In this case, the stop position values are produced by subtraction of the distance travelled between the reference position 24 and the particular stop from the position value of the reference position.

In one of the possible embodiments of the invention, a stop sensor 28 is temporarily mounted on each of the stops 10', 11' during the initialization of the controller 17. Said stop sensors are connected to the controller either by means of temporarily laid cables, or the signals from the stop sensors 28 are transmitted to the controller by means of a wireless radio connection. After the stop sensors 28 have been mounted, a learning journey, which is manually controlled or is controlled by the controller, is carried out along substantially the entire designated travel path of the elevator car 3. During said learning journey, a current elevator car position is continuously detected by the controller 17 with the aid of the pulse transmitter 15 forming a travel measuring device. Upon passing the reference position 24, a reference position value assigned to said reference position 24 is stored on the basis of a signal from the position sensor 20 and, upon passing the stops 10', 11', the stop position values corresponding to the positions of the stops are temporarily registered and stored on the basis of signals from the stop sensors 28. After ending of the learning journey or after ending of the installation phase, the stop sensors 28 are removed again.

During the operation of the elevator system 1, the elevator car 3 repeatedly passes the reference position 24. Upon passing the reference position 24, the position sensor 20 transmits the reference signal to the controller 17 via the signal line 21 or by radio. At the same time, the pulse transmitter 15 continuously detects the current elevator car position, which is transmitted to the controller 17 via the signal line 16. The reference signal brings about a comparison in the controller 17 of the current elevator car position, which is detected with the aid of the pulse transmitter 15, with the position value assigned to the reference position. If a difference is determined between the elevator car position determined by the travel measuring device or the pulse transmitter 15 and the reference position 24 stored in the memory device 27, the compensating device 26 brings about correction of the stop position values, which are stored in the memory device 27, of the stops 10', 11' with incorporation of a correction factor which is dependent on the determined difference. The corrected stop position values then cause the elevator car to be stopped again sufficiently precisely at the stops 10', 11' even if the length of the supporting means has changed. As a result, changes in length of the supporting means 5, 6 that occur, for example, during the elevator operation and occur as a result of operating loads, due to temperature fluctuations or due to ageing processes, can be corrected.

In this exemplary embodiment, precisely one reference position 24 is provided. In this case, precisely one position sensor 20 is assigned to the reference position 24. Up to a certain conveying height of the elevator system, the controller 17, by interaction with the compensating device 26, can ensure a sufficiently precise arrival at all of the stops 10', 11' without permanently installed stop sensors being required. By means of the use of two or more position sensors 20 distributed over the conveying height, together with correspondingly expanded controller and compensating devices, the stopping accuracy can be ensured even in the case of elevator systems having large conveying heights.

The reference position 24 should advantageously be arranged in such a manner that, upon the elevator car 3 passing the reference position 24, the synchronous belt length present between the driving pulley 12 and the elevator car 3 corresponds to a relatively large portion of the maximum length occurring during operation. In this case, a "relatively large portion" should be understood as meaning that, upon the elevator car 3 passing the reference position 24, the synchronous belt length present between the driving pulley 12 and the elevator car 3 corresponds to at least 30%, advantageously at least 50%, of the maximum length occurring in the region mentioned during operation. In the present exemplary embodiment, the reference position 24 is expediently arranged in the region of a ground floor or a basement. By arrangement of the at least one reference position according to these rules, changes in length of the supporting means 5, 6 are detected over a large measuring length, thus permitting sufficiently accurate corrections of the stop positions of all of the stops 10', 11'.

In the present exemplary embodiment, the reference position 24 is arranged in the region of a main stop 10'. Main stops should be considered in particular as being the stops which are located on the ground floor or stops which are provided for changing between different elevators ("sky lobbies"). The effect achieved by such an arrangement of the reference position 24 is that the latter is passed over as frequently as possible by the elevator car, and therefore the correction of the stop position values stored in the controller takes place sufficiently frequently. A main stop may be understood as meaning any stop which is arrived at by the elevator car more frequently than on average.

Each time when the position sensor 20 detects that the elevator car 3 is passing the reference position 24, the compensating device 26 can update the stop positions, which are stored in the memory device 27, for the stops 10', 11'. It can therefore be ensured that despite there being changes in length of the synchronous belts 5, 6, the elevator car stops with sufficient accuracy at the stops 10', 11'. A correction value is expediently calculated in each case for a specific stop in such a manner that the detected difference between the reference position value stored in the memory device 27 and the position value of the elevator car, which position value is detected at the reference position 24 via the pulse transmitter 15, is multiplied by a correction factor. Said correction factor approximately corresponds to the ratio of the distance between the driving pulley and the stop to the distance between the driving pulley and the reference position.

The elevator system according to the present exemplary embodiment may furthermore have a load measuring device 30 which, in the present exemplary embodiment, comprises a base plate 31 of the elevator car 3 and load sensors 32, 33. The load measuring device 30 measures the current loading of the elevator car 3. In this exemplary embodiment, the dead weight of the elevator car 3, with the exception of the base plate 31, is not transmitted to the load sensors 32, 33.

In another embodiment, the entire elevator car 3 can be suspended on the supporting means 5, 6 via a load measuring device.

The load measuring device 30 is connected to the controller 17 via a signal line 34. The current loading of the elevator car 3 that is detected by the load measuring device 30 is taken into consideration by the compensation measuring device 26 as a further variable in order to correct the stop positions stored in the memory device 27. Changes in length of the supporting means 5, 6 occur due to the loading of the elevator car 3 and the elasticity of the supporting means. The magnitude of said load-dependent changes in length is proportional to the supporting means length currently extending between the driving pulley 12, 13 and the elevator car 3, i.e. is approximately proportional to the stop position values of the stop, in the region of which the elevator car is currently located. The correction factor to be effectively included can be expediently ascertained by the fact that, by means of loading tests in the region of the reference position 24, the changes in length of the supporting means that occur there as a function of the car loading are determined. A corresponding load-proportional factor can then be stored in the controller. The calculation of the correction values of the stop position values as a function of the respectively current loading situation and the current stop takes place in the controller 17.

During the elevator operation, the loading of the elevator car 3, which loading is detected at each turn by the load measuring device 30, is preferably also used for correcting the changes in length of the supporting means 5, 6 that are determined with the aid of the position sensor 20. The difference which is determined upon passing of the reference position 24 between the elevator car position determined by the travel measurement and the stored reference position is corrected by the loading-caused change in length of the supporting means or synchronous belts 5, 6. The effect achieved by this is that the change in length of the supporting means, which is determined with the aid of the position sensor 20, and the correction factor derived therefrom for correcting the stop position values always relate to the unloaded elevator car. The effective correction of the stop position values is then produced by superimposition of the correction factor resulting from the car loading on the correction factor determined with the aid of the position sensor. The function of the compensating device 26 for correcting the stop position values is therefore simplified and is useable universally.

With the proposed system of loading compensation, an elevator system 1 with a level control for the elevator car 3 can also be realized. If the car loading in the elevator car 3 is increased or reduced at a stop, the controller on the basis of the data which is registered in any case (change in length of the supporting means as a function of the loading, currently present supporting means length between the driving pulley and elevator car, measured change in loading), can calculate an occurring change in length of the supporting means and can correct or compensate said change by a corresponding compensating movement of the drive unit 14 and/or of the driving pulley 12, 13.

In a further possible embodiment of the elevator system 1 according to the invention, the latter also comprises a temperature measuring device 40. With the aid of the ambient temperature which is reported to the controller by the temperature measuring device via a signal line 41, the controller 17 can compensate for the effect of the ambient temperature on the change in length of the supporting means. Analogously to the above-described correction factor for compensating for the car loading, during the determination of the correction of the stop position values, a temperature compensation factor to be input in the controller is superimposed on the correction factor determined with the aid of the position sensor. The effect is therefore achieved that the stored stop position values are corrected with inclusion of a correction factor which compensates for a change in length of the synchronous belt 6 as a result of temperature changes.

FIG. 2 shows a possible embodiment of the invention, in which the supporting means 5.2 and 6.2 carry out different functions. The supporting means 5.2 serves exclusively to support the elevator car 3. It is therefore guided from the elevator car via a non-driven, i.e. idling supporting roller 35, to the counterweight 4 (FIG. 1) and does not have to be designed as a synchronous belt. The supporting means 6.2 is a synchronous belt, preferably a toothed belt, and is driven synchronously to the revolutions of the drive unit 14 via the driving pulley 36, which interacts in a slip-free manner with the synchronous belt, wherein the synchronous belt expediently has to support a lower load. The advantage of such an embodiment resides in the fact that the most suitable types of belt can be used in each case for the two different functions.

The invention is not limited to the exemplary embodiments described.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system, comprising an elevator car suspended on at least one supporting means formed as a synchronous belt;

a drive unit for moving the at least one synchronous belt and the elevator car with a driving pulley interacting in a slip-free manner with the at least one synchronous belt;

a travel measuring device for measuring a movement of the at least one synchronous belt in a region of the driving pulley for determining a position of the elevator car;

a controller activating the drive unit based upon stop position values stored in the controller and the determined elevator car position wherein the elevator car is stoppable at at least two stops;

a position sensor sending a reference position signal to the controller when the elevator car passes a reference position during movement by the drive unit; and a compensating device correcting the stop position values in response to the reference position signal based upon a difference between the elevator car position determined by the travel measuring device and the reference position utilizing a correction factor which is dependent on the difference.

2. The elevator system according to claim 1 including a load measuring device for detecting a loading of the elevator car, and the compensating device additionally brings about the correction of the stored stop position values by incorporation of another correction factor which compensates for a change in length of the at least one synchronous belt as a result of load changes in the elevator car.

3. The elevator system according to claim 1 including a temperature measuring device, and the compensating device additionally brings about the correction of the stored stop position values with incorporation of another correction factor which compensates for a change in length of the at least one synchronous belt as a result of temperature changes.

4. The elevator system according to claim 1 wherein the reference position is arranged so that, upon the elevator car passing the reference position, a length of the at least one synchronous belt present between the driving pulley and the elevator car corresponds to at least 50% of a maximum length of the at least one synchronous belt present between the driving pulley and the elevator car occurring during operation.

5. The elevator system according to claim 1 wherein the reference position is arranged in a region of a main stop of the elevator system.

6. The elevator system according to claim 1 wherein more than one of the reference position is arranged in the elevator system.

7. The elevator system according to claim 1 including at least another supporting means for driving and positioning the elevator car, wherein said at least another supporting means interacts with a non-driven, idling supporting means pulley and only supports the elevator car.

8. A method for operating an elevator system with an elevator car suspended on at least one supporting means formed as a synchronous belt, a drive unit for moving the synchronous belt and the elevator car with a driving pulley interacting in a slip-free manner with the synchronous belt, a travel measuring device for continuously detecting an elevator car position by measuring a movement travel of the synchronous belt in a region of the driving pulley, and a controller, the method comprising the steps of:

activating the drive unit by the controller based upon stored stop position values and the detected elevator car position from the travel measuring device;

moving the elevator car among a plurality of stops and stopping the elevator at the stops;

determining a difference between the elevator car position which is continuously detected by the travel measuring device and a position value assigned to a reference position upon the elevator car passing the reference position; and correcting the stored stop position values with incorporation of a correction factor which is dependent on the determined difference.

9. A method for initializing a controller of an elevator system with an elevator car suspended on at least one supporting means formed as a synchronous belt, a drive unit which moves the synchronous belt and the elevator car with a driving pulley interacting in a slip-free manner with the synchronous belt, and a travel measuring device for continuously detecting an elevator car position by measuring a movement of the synchronous belt in a region of the driving pulley, comprising the steps of:

mounting a stop sensor at each stop of the elevator system;

operating the controller to control an initialization operation in which the elevator car carries out a learning travel along substantially an entire travel path of the elevator car;

during the learning travel, continuously detecting the elevator car position with the travel measuring device;

during the learning travel, the elevator car passing a reference position which is detectable by a position sensor and registering and storing a reference position value assigned to the reference position;

on the basis of signals from the stop sensors, temporarily registering stop position values assigned to the stops; and after the installation operation, removing the stop sensors.

10. The method according to claim 9 wherein the controller causes the elevator car to pass the reference position, which is detectable by the position sensor, before the stop position values are registered, wherein the reference position is registered and assigned the reference position value.

* * * * *